US008485283B2

(12) United States Patent
Baril et al.

(10) Patent No.: US 8,485,283 B2
(45) Date of Patent: Jul. 16, 2013

(54) DRILL BIT

(75) Inventors: Daniel Baril, Pierrefonds (CA); Pierre Auger, Deux-Montagnes (CA)

(73) Assignee: Groupe Fordia Inc., St-Laurent (CA)

( * ) Notice: Subject to any disclaimer, the term of this patent is extended or adjusted under 35 U.S.C. 154(b) by 546 days.

(21) Appl. No.: 12/733,478

(22) PCT Filed: Sep. 5, 2008

(86) PCT No.: PCT/CA2008/001639

§ 371 (c)(1),
(2), (4) Date: Mar. 3, 2010

(87) PCT Pub. No.: WO2009/030052

PCT Pub. Date: Mar. 12, 2009

(65) Prior Publication Data

US 2010/0170720 A1 Jul. 8, 2010

Related U.S. Application Data

(60) Provisional application No. 60/935,872, filed on Sep. 5, 2007.

(51) Int. Cl.
*E21B 10/00* (2006.01)

(52) U.S. Cl.
USPC ..... 175/403; 175/393; 175/327

(58) Field of Classification Search
USPC ..... 175/403, 393
See application file for complete search history.

(56) References Cited

U.S. PATENT DOCUMENTS

| | | | | |
|---|---|---|---|---|
| 3,509,953 A | | 5/1970 | Becker | |
| 3,692,127 A | | 9/1972 | Hampe et al. | |
| 3,833,077 A | | 9/1974 | Lavallee | |
| 4,128,136 A | * | 12/1978 | Generoux | 175/405.1 |
| 4,189,015 A | | 2/1980 | Acker et al. | |
| 4,190,125 A | | 2/1980 | Emmerich et al. | |
| 4,208,154 A | * | 6/1980 | Gundy | 408/204 |
| 4,499,959 A | | 2/1985 | Grappendorf et al. | |
| 4,739,844 A | | 4/1988 | Farris et al. | |
| 4,813,500 A | | 3/1989 | Jones | |
| 5,025,871 A | * | 6/1991 | Stewart et al. | 175/57 |
| 5,069,584 A | | 12/1991 | Obermeier et al. | |
| 5,379,852 A | * | 1/1995 | Strange, Jr. | 175/403 |

(Continued)

FOREIGN PATENT DOCUMENTS

| | | |
|---|---|---|
| EP | 0 030 558 | 6/1980 |
| EP | 0 119 620 B1 | 2/1990 |

(Continued)

*Primary Examiner* — Jennifer H Gay
*Assistant Examiner* — Elizabeth Gitlin

(57) ABSTRACT

A drill bit including a body section. The body section defines a body proximal end and a longitudinally opposed body distal end, and a body passageway extending longitudinally therethrough for receiving a fluid and conveying the fluid through the body section. An annular crown section extends longitudinally from the body section, the crown section defining a crown distal end and a longitudinally opposed crown proximal end, the crown section extending distally from the body section, the crown section defining a crown passageway extending longitudinally therethrough and in fluid communication with the body passageway. A flow directing component cooperates with the crown section to define a fluid flow channel extending through the crown section radially outwardly from the crown passageway, the fluid flow channel being self-modifiable upon the crown section reaching a predetermined wear threshold so as to modify a flow of the fluid through the fluid flow channel.

18 Claims, 7 Drawing Sheets

U.S. PATENT DOCUMENTS

| | | | | |
|---|---|---|---|---|
| 5,803,193 | A | 9/1998 | Krueger et al. | |
| 6,527,064 | B1 | 3/2003 | Hallundbaek | |
| 7,611,312 | B2 * | 11/2009 | Miyanaga | 408/204 |
| 7,641,004 | B2 * | 1/2010 | Lapointe | 175/405.1 |
| 7,946,362 | B2 * | 5/2011 | Da Silva et al. | 175/434 |
| 8,051,929 | B2 * | 11/2011 | Drivdahl et al. | 175/403 |
| 2007/0246266 | A1 * | 10/2007 | Larbo | 175/434 |
| 2010/0089660 | A1 * | 4/2010 | Pearce et al. | 175/403 |

FOREIGN PATENT DOCUMENTS

| | | | |
|---|---|---|---|
| EP | 0 480 263 | A1 | 4/1992 |
| EP | 0 363 313 | B1 | 8/1992 |
| WO | WO 01/92677 | A1 | 12/2001 |

* cited by examiner

DRILL BIT

The present application is a National Stage Entry of PCT Application Serial Number PCT/CA2008/001639 filed on Sep. 5, 2008, which application claims priority from United States Provisional Patent Application Serial Number 60/935,872 filed on Sep. 5, 2007.

FIELD OF THE INVENTION

The present invention relates to the general field of drilling, and is particularly concerned with a drill bit.

BACKGROUND

In the geological exploration, mining and construction industries, among others, drill bits 10, an example of which is shown in FIG. 1, are used to drill through rock, concrete and other materials. Typically, as seen in FIG. 1, the drill bit 10 includes a body section 12 and a crown section 14 extending substantially longitudinally from the body section 12. Slots 16 are formed into the crown section 14 and define drilling segments 18. The crown section 14 is the portion of the drill bit 10 that erodes the material through which a bore is drilled. The body section 12 and the crown section 14 define a central passageway 20 through which water (not shown in FIG. 1) is injected. The slots 16 allow water, generally represented by the arrows 24 in FIG. 2, and debris (not shown in the drawings) to flow out of the central passageway 20.

As seen in FIG. 2, water flows from the central passageway 20, through the slot 16, and returns outside of the body section 12. In some prior art drill bits, the crown section 14 extends over a relatively large distance away from the support member 12, and the slots 16 therefore extend substantially longitudinally over a relatively large distance. This may cause the water 24 to flow through the slot 16 without reaching a distal end surface 25 of the crown section 14. Therefore, in these embodiments, the capability of the water 24 to remove debris from the region at which the crown section 14 contacts rock or other material through which drilling is performed and to cool the crown section 14 is relatively reduced.

The flow of water 24 is typically useful in enhancing drilling efficiency and in preserving the integrity of the crown section 14. Therefore, to improve the durability of the crown section 14, it has been found that, in some embodiments of the invention, the water circulation properties of the water 24 are not optimal and need to be enhanced.

Against this background, there exists a need in the industry to provide an improved drill bit. An object of the present invention is therefore to provide an improved drill bit.

SUMMARY OF THE INVENTION

A drill bit usable with a fluid, the drill bit comprising a body section, the body section defining a body proximal end and a substantially longitudinally opposed body distal end, the body section defining a body passageway extending substantially longitudinally therethrough for receiving the fluid and conveying the fluid through the body section; a substantially annular crown section extending substantially longitudinally from the body section, the crown section defining a crown distal end and a substantially longitudinally opposed crown proximal end, the crown section extending from the body section with the crown proximal end located substantially adjacent to the body distal end, the crown section defining a crown passageway extending substantially longitudinally therethrough, the crown passageway being in fluid communication with the body passageway for receiving the fluid from the body passageway; and a flow directing component cooperating with the crown section to define a fluid flow channel, the fluid flow channel extending through the crown section substantially radially outwardly from the crown passageway, the fluid flow channel being self-modifiable upon the crown section reaching a predetermined wear threshold so as to modify a flow of the fluid through the fluid flow channel when the crown section reaches the predetermined wear threshold.

Advantageously, the proposed drill bit keeps near optimal fluid flow characteristics through the fluid flow channel over a relatively large range of crown section wear degrees.

Also, the proposed drill bit is relatively easily manufacturable using known methods and materials. Typically, the flow directing component is made out of a material softer than the material making out the crown so as to facilitate destruction or detachment from the crown section of the flow directing component. Furthermore, in some embodiments of the invention, the flow directing component is relatively easily manufacturable at relatively low costs and is easily attachable to the proposed drill bit.

In a variant, the drill bit includes a plurality of slots each having a slot reinforcing member extending substantially circumferentially thereacross. The slots define a plurality of drilling segments, the slot reinforcing members interconnecting the segments to each other. One flow directing component is secured to each of the slot reinforcing members and obstructs partially the corresponding slot.

In some embodiments of the invention, the proposed flow directing component itself is self-destructible upon the crown section reaching the predetermined wear threshold. In other embodiments, the flow directing component is attached to the crown section and is detachable automatically from the crown section upon the crown section reaching the predetermined wear threshold.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
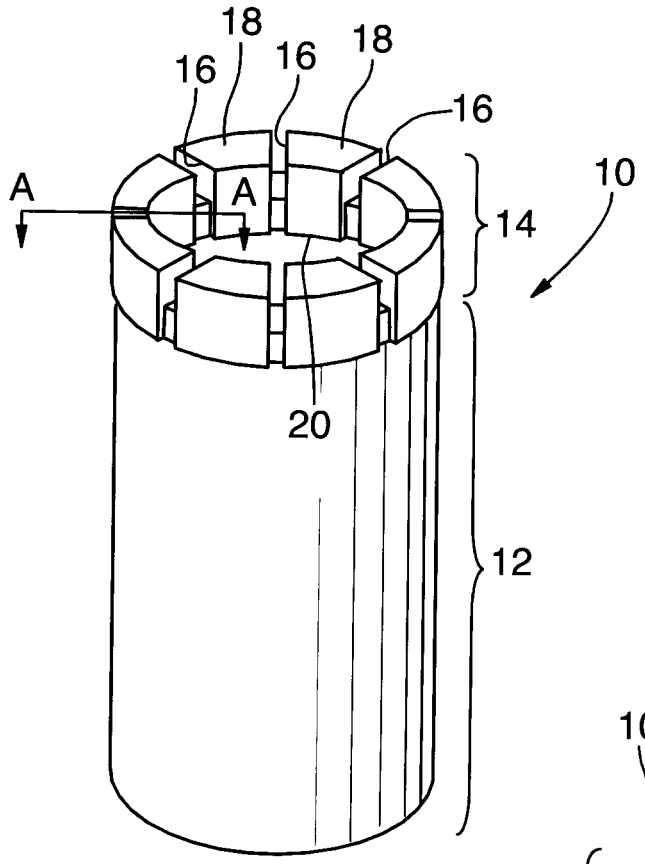
FIG.1 (PRIOR ART)
FIG. 1, already described, in a perspective view, illustrates a prior art drill bit.
Figure 2:
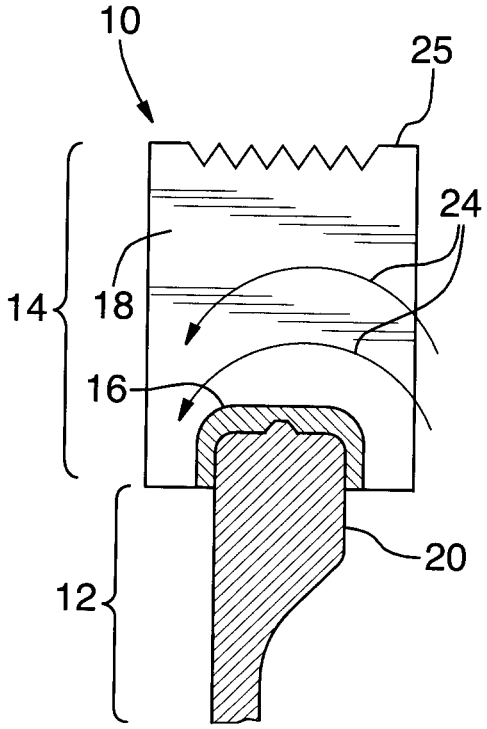
FIG.2 (PRIOR ART)
FIG. 2, already described, in a partial side cross-sectional view taken along the line A-A of FIG. 1, illustrates the drill bit of FIG. 1.
Figure 3:
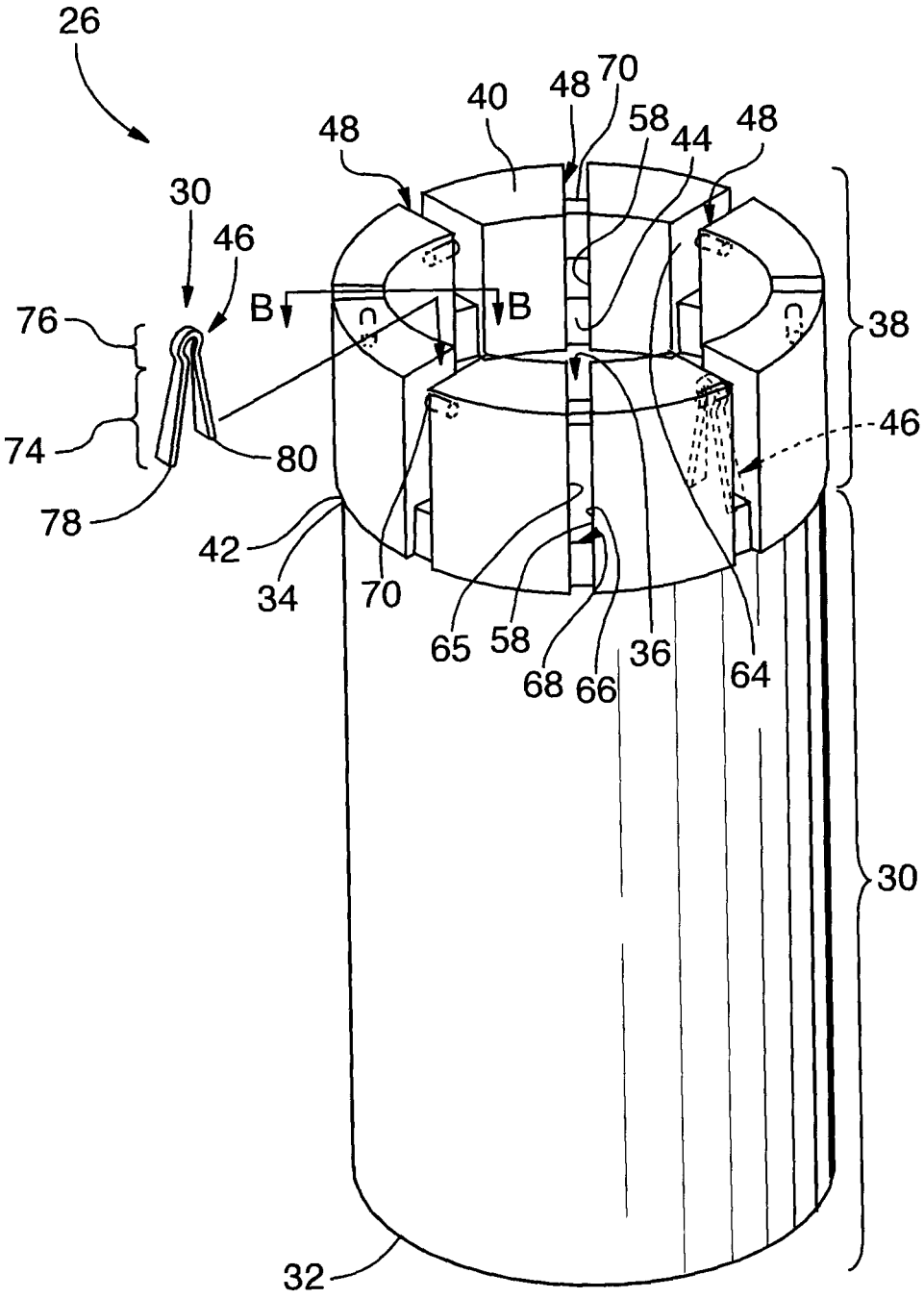
FIG. 3, in a perspective view, illustrates a drill bit in accordance with an embodiments of the present invention.
Figure 4:
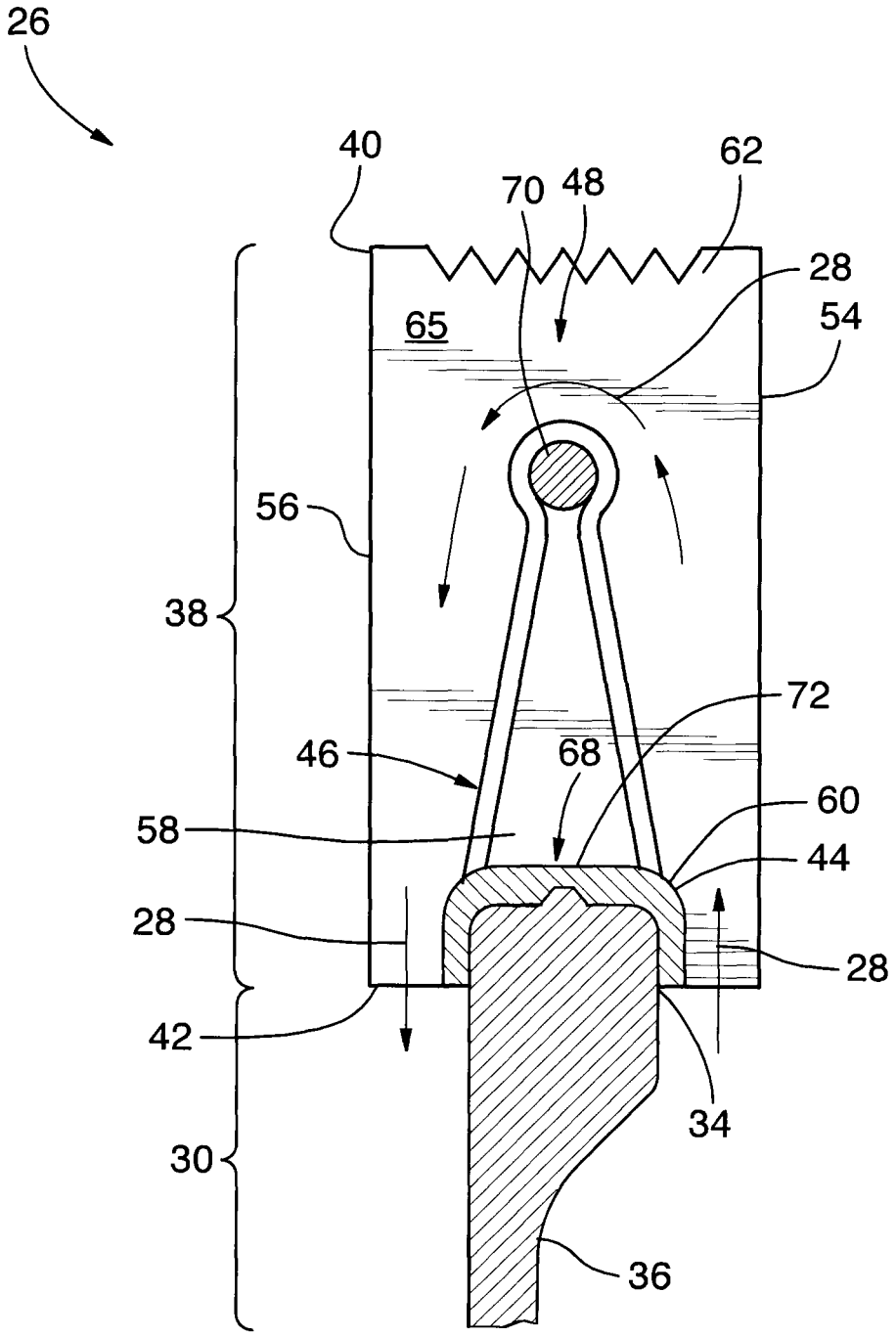
FIG. 4, in a partial side cross-sectional view taken along the line B-B of FIG. 3, illustrates the drill bit of FIG. 3.

Referring to FIGS. 3 and 4, there is shown a drill bit 26 usable with a fluid 28, the fluid 28 being shown only in FIG. 4. Typically the fluid 28 includes water to which additives may have been added. The drill bit 26 includes a body section 30, the body section 30 defining a body proximal end 32 (shown only in FIG. 3) and a substantially longitudinally opposed body distal end 34. The body section 30 defines a body passageway 36 extending substantially longitudinally therethrough for receiving the fluid 28 and conveying the fluid 28 through the body section 30.

The drill bit 26 also includes a substantially annular crown section 38 extending substantially longitudinally from the body section 30. The crown section 38 defines a crown distal end 40 and a substantially opposed crown proximal end 42. The crown section 38 extends from the body section 30 with the crown proximal end 42 located substantially adjacent to the body distal end 34. The crown section 38 defines a crown passageway 44 extending substantially longitudinally, the crown passageway 44 being in fluid communication with the body passageway 36 for receiving the fluid 28 from the body passageway 36. A flow directing component 46 cooperates with the crown section 38 to define a fluid flow channel 48. The fluid flow channel 48 extends through the crown section 38 substantially radially outwardly from the crown passageway 44.

The fluid flow channel 48 is self-modifiable upon the crown section 38 reaching a predetermined wear threshold so as to modify the flow of the fluid 28 through the fluid flow channel 48 when the crown section 38 reaches the predetermined wear threshold. In FIG. 3, two flow directing components 46 are illustrated. More specifically, one of the flow directing components 46 is shown detached from the crown section 38, while another one of the flow directing components 46 is shown attached to the crown section 38.

In the embodiment of the invention shown in the drawings, many substantially circumferentially spaced apart fluid flow channels 48 are defined in the drill bit 26. While a drill bit 26 including eight fluid flow channels 48 is illustrated, it is within the scope of the invention to include any suitable number of the fluid flow channels 48 in the drill bit 26. Furthermore, one or more of the fluid flow channels 48 may include the flow directing component 46, and other ones of the fluid flow channels 48 may be deprived from the flow directing components 46 without departing from the scope of the present invention. The flow directing components 46 may therefore be selectively attachable to the crown section 38 so as to allow flexibility in the fluid flow regulation through the fluid flow channels 48.

In some embodiments of the invention, the flow directing component 46 is self-destructible upon the crown section 38 reaching the predetermined wear threshold. This is achievable, for example, by ensuring that a portion of the flow directing component 46 that is crucial for the attachment of the flow directing component 46 to the crown section 38 is destroyed rapidly when the crown section 38 reaches the predetermined wear threshold. In some embodiments of the invention, this self-destruction is facilitated by using a relatively soft material, such as steel, for the flow directing component 46, while the crown section 38 includes conventional diamond-encrusted matrices that are relatively robust and wear resistant.

In some embodiments of the invention, the flow directing component 46 is attached to the crown section 38. In a variant, the flow directing component 46 is self-destructible, as described hereinabove. In another variant, the flow directing component 46 is detachable automatically from the crown section 38 upon the crown section 38 reaching the predetermined wear threshold. This is achievable, for example, by attaching a relatively robust flow directing component 46 to the crown section 38 through relatively weak attachments. In other embodiments of the invention, the flow directing component 46 extends integrally as a single piece of material from the crown section 38 but is coupled thereto through relatively thin links, as described in greater details hereinbelow.

Figure 5:
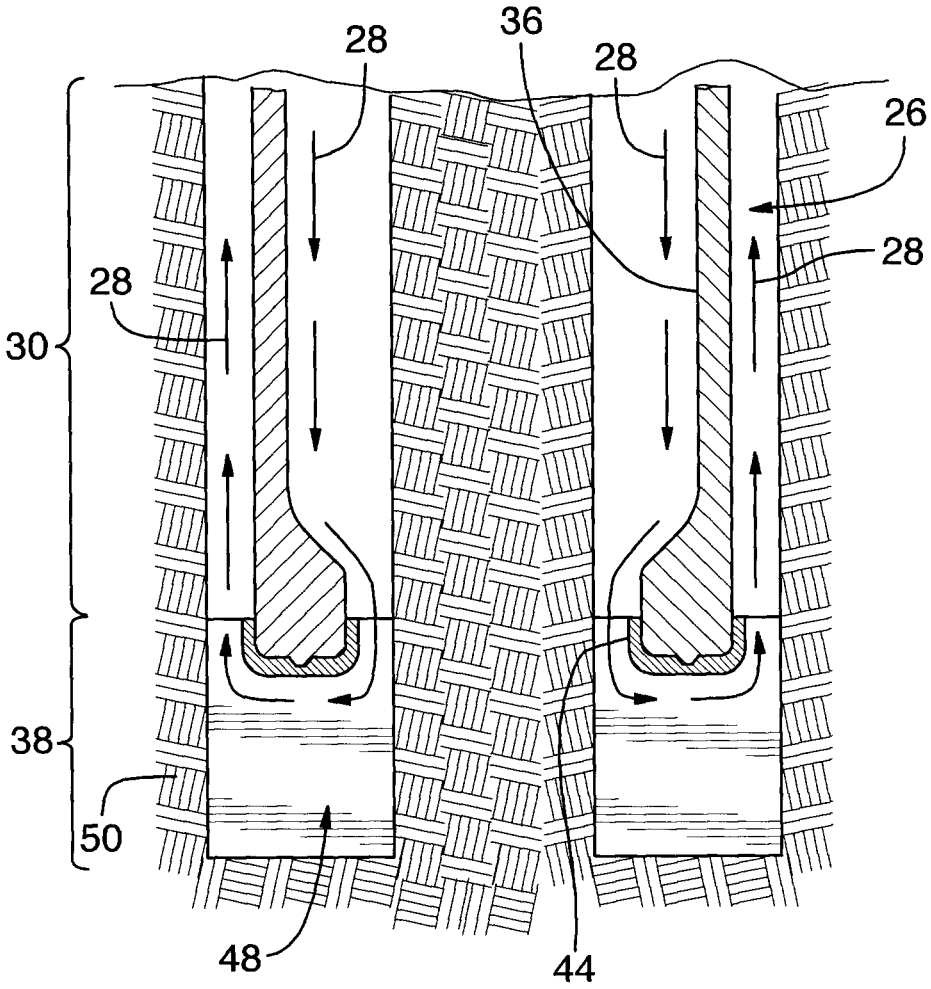
FIG. 5, in a side cross-sectional view, illustrates the drill bit shown in FIGS. 3 and 4 drilling through a material.

Typically, the drill bit 26 is usable to drill through a material 50, as shown in FIG. 5, when injecting the fluid 28 into the body passageway 36. In FIG. 5, the drill bit 26 is shown after the predetermined wear threshold has been reached and the flow directing component 46 has been destroyed. The predetermined wear threshold is typically such that the crown section 38 is cooled by the fluid 28 when drilling through the material 50 both before and after the predetermined wear threshold has been reached, which is achievable by suitable configuring and sizing the flow directing component 46.

Returning to 4, there is shown a specific example of the drill bit 26 allowing for the achievement of the above described functionalities. The drill bit 26 includes a crown section 38 that defines a radially inwardmost crown inner surface 54. The crown inner surface 54 delimits the crown passageway 44. The crown section 38 also defines a radially outwardmost crown outer surface 56 and one, and typically a set, of slots 58 extend substantially radially through the crown section 38 between the crown inner and outer surfaces 54 and 56, the slots 58 being better seen in FIG. 3. The slots 58 each define a slot proximal end 60 and a substantially longitudinally opposed slot distal end 62, the slot distal end 62 being typically substantially adjacent to the crown distal end 40. Therefore, each of the slots 58 typically defines a gap 64 at the slot distal end 62. However, it is within the scope of the invention to have slots 58 that are not opened at the slot distal end 62, and that are therefore longitudinally interrupted before reaching the crown distal end 40.

The slots 58 each define substantially opposed slot lateral walls 65 and 66 that are substantially circumferentially spaced apart from each other around the crown section 38 (only one of which is seen in FIG. 4). Each slot 58 also defines a slot proximal wall 68 substantially adjacent the slot proximal end 60, the slot lateral walls 65 and 66 typically extending substantially longitudinally away from the slot proximal wall 68. In some embodiments of the invention, the slot proximal wall 68 has a a radial cross-section having a substantially convex configuration and defines an apex 72. However, in alternative embodiments of the invention, the slot proximal wall 68 has any other radial cross-sectional configuration.

In some embodiments of the invention, the slots 58 define a slot reinforcing member 70 extending substantially circumferentially across the slot 58, between the slot lateral walls 65 and 66, at a location spaced apart from the slot proximal wall 68.

As better seen in FIG. 3, the flow directing component 46 typically includes a flow directing portion 74 and an attachment portion 76. The flow directing portion 74 is located inside the slot 58 when the flow directing component is attached to the crown section 38 and is provided for directing the flow of the fluid 28 therearound inside the slot 58. The attachment portion 76 is provided for attaching the flow directing component 46 to the crown section 38, for example, in some embodiments of the invention, to the slot reinforcing member 70. The attachment portion 76 is operatively coupled to the flow directing portion 74 for positioning the flow directing portion 74 inside the slot 58. In the embodiment of the invention shown in the drawings, the flow directing portion 74 substantially obstructs the slot 58 between the slot reinforcing member 70 and the slot proximal wall 68. Therefore, in this embodiment, when the flow directing portion 74 is present in the slot 58, before the predetermined wear threshold has been reached, substantially no fluid 28 can flow through the slot 58 between the slot proximal wall 68 and the slot reinforcing member 70. This causes substantially all the fluid 28 to be directed towards the crown distal end 40 so as to facilitate cooling of the crown section 38 when drilling is performed and facilitate clearing of debris produced by the drilling process. In some embodiments of the invention, the flow directing portion 74 extends longitudinally along between about 25 and about 75 percents of the slot 58 when the drill bit 26 is manufactured, but other values of this extent are within the scope of the present invention.

In some embodiments of the invention, the attachment portion 76 includes an arc segment of a cylinder encircling partially the slot reinforcing member 70. For example, the slot reinforcing member 70 has a substantially cylindrical configuration and the arc segment of the cylinder extends longitudinally further away from the slot proximal wall 68 than the slot reinforcing member 70. In this configuration, when the drill bit 26 has been worn down to a point where the arc segment of the cylinder forming the attachment portion 76 of the flow directing component 46 is exposed to the material through which drilling is performed, the attachment portion 76 is relatively rapidly eroded so as to self-destruct the flow directing component 46 to allow a flow of the fluid 28 through the proximal section of the slot 58.

In the embodiment of the invention shown in the drawings, the flow directing portion 74 includes a pair of legs 78 and 80 each extending from the attachment portion 76, the legs 80 typically extending up to the slot proximal wall 68 so that the flow directing portion 74 abuts against the slot proximal wall 68 so as to limit pivotal movements of the flow directing component 46 about the slot reinforcing member 70. The legs 78 and 80 are typically positioned radially inwardly and outwardly relatively to the slot reinforcing member 70 so that the apex 72 of the slot proximal wall 68 is received therebetween. This configuration ensures stability of the position of the flow directing component 46 when attached to the crown section 38.

Therefore, in this embodiment, the flow directing component 46 has a substantially key-hole shape cross-sectional configuration and is typically attachable to the crown section 38 and, more specifically, to the slot reinforcing member 70, by being substantially resiliently deformable so that the two legs 78 and 80 may be spread apart to insert the attachment portion 76 onto the slot reinforcing member 70. Typically, the flow directing component has a substantially uniform radial cross-sectional configuration along a circumferential direction, the terminology radial and circumferential being relative to the configuration of the substantially annular crown section 38.

Figure 6:
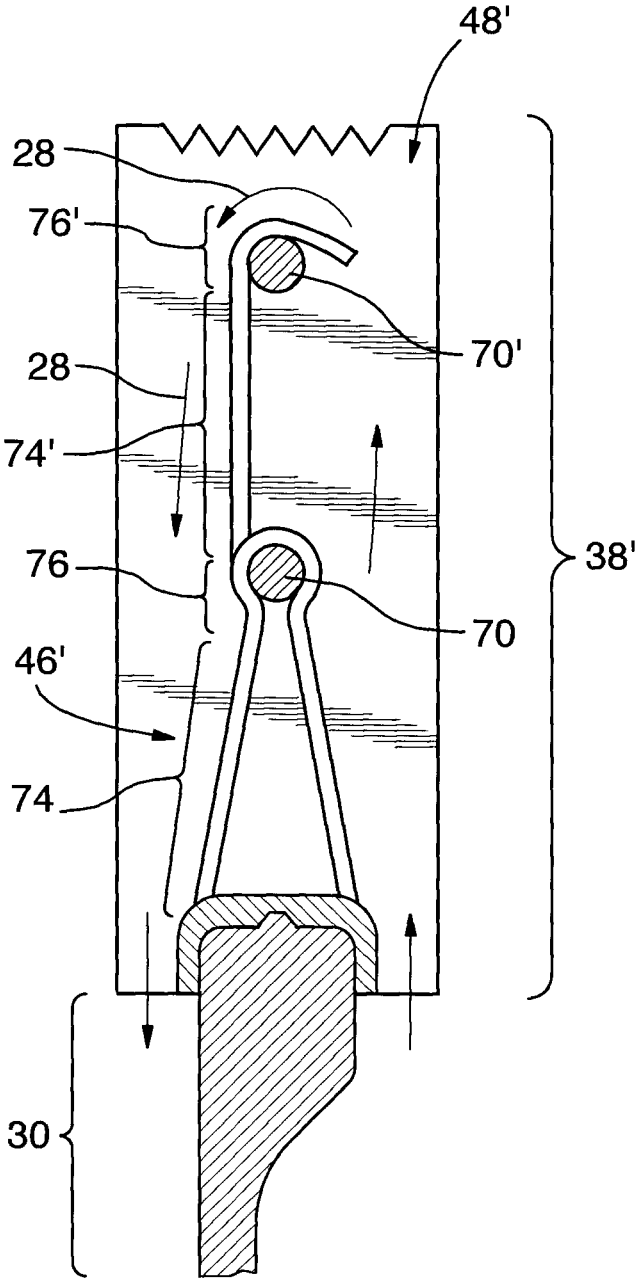
FIG. 6, in a partial side cross-sectional view, illustrates a drill bit in accordance with an alternative embodiment of the present invention.

FIG. 6 illustrates an alternative flow directing component 46' wherein the fluid flow channel 48' is self-modifiable to a first modified configuration upon the crown section 38' reaching a first predetermined wear threshold so as to modify the flow of the fluid 28 through the fluid flow channel 48' when the crown section 38' reaches the first predetermined wear threshold. The fluid flow 48' channel is self-modifiable to a second modified configuration upon the crown section 38' reaching a second predetermined wear threshold so as to further modify a flow of the fluid 28 through the fluid flow channel 48' when the crown section 38' reaches the second predetermined wear threshold. The crown section 38' is worn to a greater extent when the crown section 38' reaches the second predetermined wear threshold than when the crown section 38' reaches the first predetermined wear threshold.

To that effect, the flow directing component 46' includes two flow directing portions 74 and 74' and two attachment portions 76 and 76'. Also, the crown section 38' defines a second slot reinforcing member 70' extending substantially parallel to the first slot reinforcing member 70 in a substantially longitudinally spaced apart relationship relatively thereto. The alternative flow directing component may be broken at two different locations so as to optimize fluid flow at three different levels of wear of the crown section 38'.

The first attachment portion 76 and the first flow directing portion 74 are substantially similar to those present in the above-described flow directing component 46. The second attachment portion 76' and the second flow directing portion 74' are together substantially J-shaped in radial cross-sectional configuration, the terminology radial applying relatively to the annular configuration of the crown section 38', and extend integrally substantially longitudinally from the first attachment portion 76. The second flow directing portion 74' is therefore substantially plate-shaped and the second attachment portion 76', which extends from the second flow directing portion 74', is substantially arcuate. The second attachment portion 76' is hooked around the second slot reinforcing member 70'. The second flow directing portion 74' is detached from the first attachment portion 76 when frictional forces exerted thereonto become relatively large, which occurs typically when the crown section 38' is worn down so that is extends longitudinally only minimally more than the second slot reinforcing component 70'. In some embodiments, this is facilitated by having a relatively weak junction between the first attachment portion 76 and the second flow directing portion 74'.

In FIG. 6, the second attachment portion 76' is seen opening towards the interior of the crown section 38'. This configuration is believed to facilitate detachment of the second flow directing portion 74' when required. In alternative embodiments of the invention, the second attachment portion 76' is positioned so as to open towards the exterior of the crown section 38', which is believed to stabilize the attachment of the flow directing portion 74' to the crown section 38'. The orientation to use depends on the specific application of the flow directing component 46' and of material parameters and dimensions of the flow directing component 46' and crown section 38'. In some embodiments of the invention, the flow directing component 46' is selectively attachable to the crown section 38' in both of the above-described orientations to enhance the flexibility in use of the flow directing component 46' to many situations. These remark are also applicable to any other flow directing component 46' that presents an asymmetry in a radial direction when attached to the crown section 38'.

Figure 7:
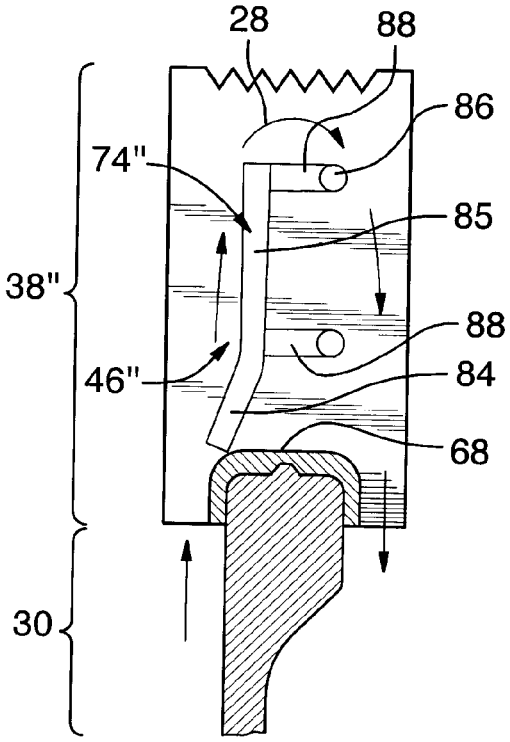
FIG. 7, in a partial side cross-sectional view, illustrates a drill bit in accordance with another alternative embodiment of the present invention.
Figure 8:
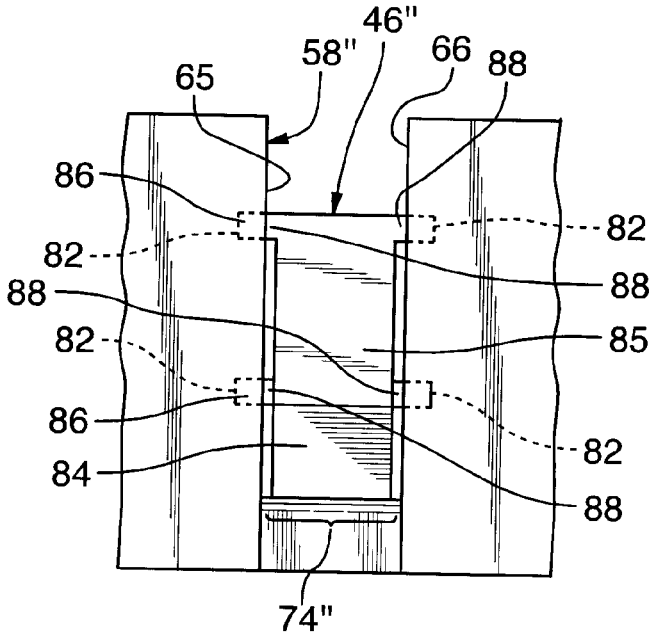
FIG. 8, in a partial front elevation view, illustrates the drill bit shown in FIG. 7.

FIGS. 7 and 8 illustrate yet another embodiment of the invention in which the slot 58" defines a pair of substantially longitudinally spaced apart attachment recesses 82 in each of the slot lateral walls 65 and 66. In FIG. 7, the flow of the fluid 28 is reversed with respect to the flow of the fluid 28 in the other embodiments of the invention described herein. While atypical, such an orientation of the flow of fluid 28 is compatible with some embodiments of the invention. Also, the alternative flow directing component 46" is also usable in some embodiments with the fluid 28 flowing in the direction illustrated on FIG. 6. The flow directing portion 74" of the alternative flow directing component 46" takes the form of substantially two plates 84 and 85 that extend from each other, that are angled relatively to each other, and that extend substantially across the slot 58".

The flow directing portion 74" is attached to the crown section 38" through pins 86 that extend from legs 88, the legs 88 extending from the flow directing portion 74". More specifically, two pairs of substantially longitudinally spaced apart legs 88 and corresponding pins 86 are provided, the two pairs of substantially longitudinally spaced apart pins 86 being circumferentially spaced apart from each other and each of the pins 86 being insertable into a respective one of the attachment recesses 82 for attaching the flow directing component 46" to the crown section 38". Having pairs of substantially longitudinally spaced apart pins 86 that are themselves circumferentially spaced apart provides four anchor points distributed along a rectangle, which provides stability to the attachment of the flow directing component 46" to the crown section 38".

The first plate 84 is abutting against the slot proximal wall 68 to further stabilize the flow directing component 46" against pressures exerted by the fluid 28 when the fluid 28 is injected inside the drill bit 26 in which the flow directing component 46" is provided. In some embodiments of the invention, the pins 86 are each provided at the end of a substantially radially extending leg 88 extending from the flow directing portion 74", the legs 88 extending substantially radially and the pins 86 extending substantially circumferentially from the legs 88, all orientations being once again described with respect to the annular configuration of the crown section 38". In this configuration, having legs 88 that are substantially resiliently deformable facilitates the insertion of the pins 86 inside the attachment recesses 82.

In some embodiments of the invention, the flow directing component 46" is not removably attachable to the crown section 38 but is instead integrally formed into the slot 58", but is otherwise shaped similarly to the above-described flow directing component 46". In these embodiments, having pins 86 that extend integrally from the slot lateral walls 65 and 66 and that are relatively weak facilitates relatively easily breaking of these pins 86 when the predetermined wear threshold is reached.

Figure 9:
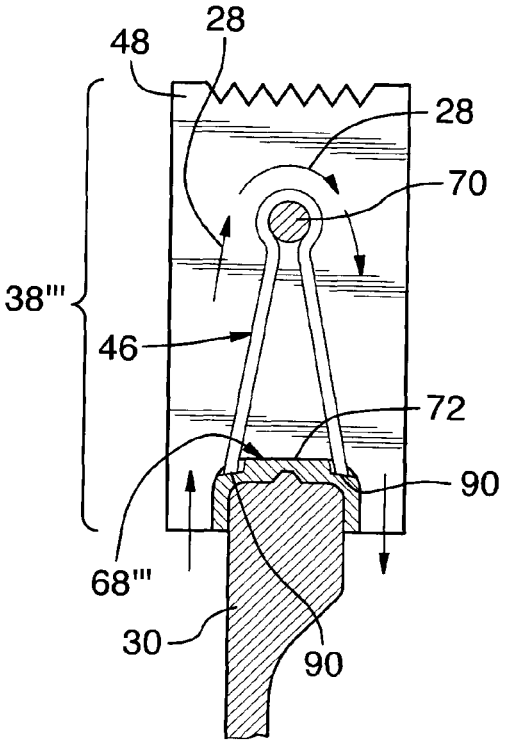
FIG. 9, in a partial side cross-sectional view, illustrates a drill bit in accordance with yet another alternative embodiment of the present invention.

FIG. 9 illustrates another embodiment of the invention in which the slot proximal wall 68'" of an alternative crown section 38'" defines two substantially recesses in the form of two circumferentially extending grooves 90 for receiving the distal end of the flow directing component 46. Otherwise, this embodiment is substantially similar to the embodiment shown in FIGS. 3 and 4.

Figure 10:
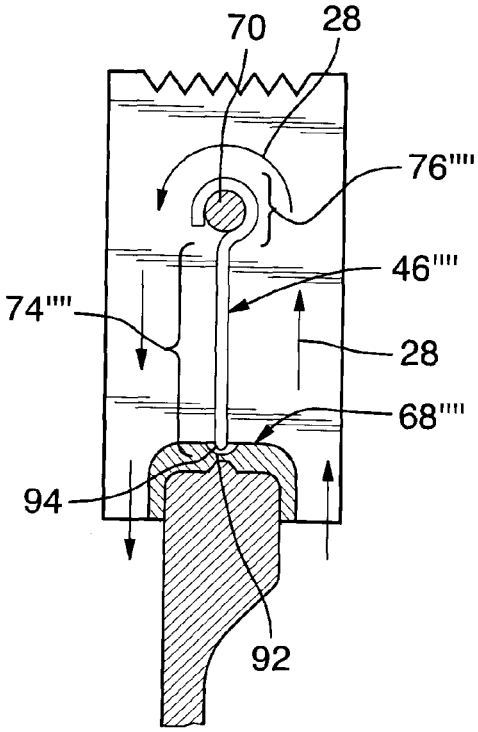
FIG. 10, in a partial side cross-sectional view, illustrates a drill bit in accordance with yet another alternative embodiment of the present invention.

In yet other embodiments of the invention, as seen in FIG. 10, an alternative slot obstructing component 46"" with an alternative slot proximal wall 68"". The slot obstructing component 46"" is substantially question mark shaped and includes a substantially arc segment shaped attachment portion 76"" for attaching the slot obstructing component 46"" to the slot reinforcing member 70. Also, the slot obstructing component 46'" includes a substantially plate-shaped flow obstructing section 74"" extending from the attachment portion 76"". The slot proximal wall 68"" defines a recess 92 for receiving a directing portion proximal end 94 of the attachment portion 76"" thereinto.

In all of the above described embodiments, as drilling is performed, the crown section 38 wears down until the flow directing component 46 is exposed to reaction forces caused by the drilling process. These forces cause the flow directing component 46 to either detach of self-destroy so as to allow fluid 28 to go through the section of the slot 58 that was previously occupied by the flow directing portion 74. Therefore, a relatively constant flow of the fluid is directed towards the crown distal end 40, which is exposed to relatively large frictional forces when drilling is performed, and is therefore at risk of overheating or being unduly worn down by abrasion with debris.

Although the present invention has been described hereinabove by way of preferred embodiments thereof, it can be modified, without departing from the spirit and nature of the subject invention as defined in the appended claims.

What is claimed is:

1. A drill bit usable with a fluid, said drill bit comprising:

a body section, said body section defining a body proximal end and a substantially longitudinally opposed body distal end, said body section defining a body passageway extending substantially longitudinally therethrough for receiving said fluid and conveying said fluid through said body section;

a substantially annular crown section extending substantially longitudinally from said body section, said crown section defining a crown distal end and a substantially longitudinally opposed crown proximal end, said crown section extending from said body section with said crown proximal end located substantially adjacent to said body distal end, said crown section defining a crown passageway extending substantially longitudinally therethrough, said crown passageway being in fluid communication with said body passageway for receiving said fluid from said body passageway; and a flow directing component cooperating with said crown section to define a fluid flow channel, said fluid flow channel extending through said crown section substantially radially outwardly from said crown passageway, said flow directing component being detachable from said crown section upon said crown section reaching a predetermined wear threshold so as to increase by a predetermined quantity a flow of said fluid through said fluid flow channel when said crown section reaches said predetermined wear threshold;

wherein said flow directing component is configured and sized to remain attached to said crown section until said crown section reaches said predetermined wear threshold and to suddenly detach from said crown section when said crown section reaches said predetermined wear threshold.

2. A drill bit as defined in claim 1, wherein said flow directing component extends integrally as a single piece of material from said crown section and is detachable automatically from said crown section upon said crown section reaching said predetermined wear threshold.

3. A drill bit as defined in claim 1, wherein said flow directing component is selectively attachable to said crown section.

4. A drill bit as defined in claim 1, wherein said drill bit is usable to drill through a material while injecting said fluid into said crown passageway, said fluid flow passageway being configured and sized such that said crown section is cooled by said fluid substantially adjacent said crown distal end when drilling through said material both before and after said predetermined wear threshold has been reached.

5. A drill bit as defined in claim 1, wherein said fluid flow channel is self-modifiable to a first modified configuration upon said crown section reaching a first predetermined wear threshold so as to modify said flow of said fluid through said fluid flow channel when said crown section reaches said first predetermined wear threshold and said fluid flow channel is self-modifiable to a second modified configuration upon said crown section reaching a second predetermined wear threshold so as to further modify a flow of said fluid through said fluid flow channel when said crown section reaches said second predetermined wear threshold, said crown section being worn to a greater extent when said crown section reaches said second predetermined wear threshold than when said crown section reaches said first predetermined wear threshold.

6. A drill bit as defined in claim 1, wherein said crown section defines a radially inwardmost crown inner surface, said crown inner surface delimiting said crown passageway;

a radially outwardmost crown outer surface; and a slot extending substantially radially through said crown section between said crown inner and outer surfaces;

said flow directing component defines a flow directing portion located inside said slot.

7. A drill bit as defined in claim 6, wherein said slot defines a slot proximal end and a substantially longitudinally opposed slot distal end, said slot distal end being substantially adjacent to said crown distal end.

8. A drill bit as defined in claim 6, wherein said slot defines a slot reinforcing member extending substantially circumferentially thereacross at a location spaced apart from said slot proximal end, said flow directing component defining an attachment portion for attaching said flow directing component to said slot reinforcing member, said attachment portion being operatively coupled to said flow directing portion for positioning said flow directing portion inside said slot.

9. A drill bit as defined in claim 8, wherein said flow directing portion substantially obstructs said slot between said slot reinforcing member and said slot proximal end.

10. A drill bit as defined in claim 8, wherein said attachment portion includes an arcsegment of a cylinder encircling partially said slot reinforcing member.

11. A drill bit as defined in claim 10, wherein said arcsegment of said cylinder extends longitudinally further away from said slot proximal end than said slot reinforcing member.

12. A drill bit as defined in claim 8, wherein said slot defines a slot proximal wall substantially adjacent at said slot proximal end, said slot proximal wall having a substantially convex configuration, said flow directing component abutting against said slot proximal wall so as to limit pivotal movements of said flow directing component about said slot reinforcing member.

13. A drill bit as defined in claim 12, wherein said slot proximal wall defines an apex, said flow directing portion including a pair of legs extending from said attachment portion, said apex being received between said legs.

14. A drill bit as defined in claim 12, wherein said slot proximal wall defined a recess for receiving a portion of said flow directing component.

15. A drill bit as defined in claim 6, wherein said slot defines a pair of substantially circumferentially opposed lateral walls, each of said lateral walls defining at least one attachment recess extending thereinto, said attachment portion including at least two pins each insertable in a respective one of said attachment recesses.

16. A drill bit as defined in claim 15, wherein each of said lateral walls defines a pair of substantially longitudinally spaced apart attachment recesses and said attachment portion includes two pairs of substantially longitudinally spaced apart pins, said two pairs of substantially longitudinally spaced apart pins being substantially circumferentially spaced apart from each other, each of said pins being insertable in a respective one of said attachment recesses for attaching said flow directing component to said crown section.

17. A drill bit as defined in claim 6, wherein said flow directing portion extends substantially longitudinally along about 25 to about 75 percents of said slot.

18. A drill bit as defined in claim 6, wherein said flow directing portion defines a directing portion proximal end, said slot defines a slot proximal wall, said slot proximal wall defining a recess for receiving said directing portion proximal end thereinto.

* * * * *